US005135328A

United States Patent [19]

Chen

[11] Patent Number: 5,135,328

[45] Date of Patent: Aug. 4, 1992

[54] PROCESS FOR CONSTRUCTING BASEMENT

[76] Inventor: Yen-Huang Chen, No. 97-1, Chung-Ching Rd., Taichung City, Taiwan

[21] Appl. No.: 817,434

[22] Filed: Jan. 6, 1992

Related U.S. Application Data

[63] Continuation of Ser. No. 606,033, Oct. 30, 1990, abandoned.

[51] Int. Cl.[5] ..... E02D 5/00; E02D 27/00

[52] U.S. Cl. ..... 405/229; 405/133; 405/249

[58] Field of Search ..... 405/229, 230, 249, 133, 405/258

[56] References Cited

U.S. PATENT DOCUMENTS

| | | | |
|---|---|---|---|
| 718,441 | 1/1903 | Ewen | 405/229 |
| 2,213,169 | 8/1940 | Ouchi | 405/229 |
| 2,678,540 | 5/1954 | Lorenz | 405/249 |
| 4,938,634 | 7/1990 | Lee | 405/229 |

FOREIGN PATENT DOCUMENTS

| | | | |
|---|---|---|---|
| 0912836 | 3/1982 | U.S.S.R. | 405/249 |

*Primary Examiner*—Dennis L. Taylor
*Attorney, Agent, or Firm*—Ladas & Parry

[57] ABSTRACT

A basement is constructed by the steps of: (a) excavating spaced vertical holes along the border of a construction site to the depth of bearing strata for the basement; (b) forming piles at the bottoms of the vertical holes; (c) erecting steel posts in the vertical holes on the piles to serve as main posts of the basement; (d) excavating soil from the entire area of the construction site to form an upper part of a cavity to receive the basement, the depth of the upper part of the cavity being far above the bearing strata; (e) forming upper portions of concrete walls of the basement along the wall of the cavity; (f) forming the remaining portions of the concrete walls extending downward from the bottoms of the upper portions of the concrete walls to the bearing strata by alternatively repeating the steps (d) and (e).

3 Claims, 4 Drawing Sheets

PROCESS FOR CONSTRUCTING BASEMENT

This is a continuation of copending application Ser. No. 07/606,033 filed on Oct. 30, 1990 now abandoned.

BACKGROUND OF THE INVENTION

1. Field of the Invention

This invention relates to a process for constructing a basement and particularly to a process for constructing a multi-floor basement by forming concrete walls of the basement part by part from near the ground to bearing strata.

2. Description of the Related Prior Art

Conventionally, most basements are constructed by first excavating to the depth of bearing strata and then forming the concrete walls of the basement in the excavated area beginning from the deepest end of the excavation. Problems have been encountered in this conventional method. The large excavated area in the ground of the construction site tends to loosen the surrounding soil and cause it to collapse. In some cases, the buildings in the immediate vicinity of the construction site suffer from the risk of being tilted or sunken. In many cases, the loosened soil collapses and injures the workmen who are working at the deepest level before the protective concrete walls of the basement are formed.

The cassion method is another method for constructing a basement. In this method, the basement is constructed on the ground and then forced into the ground which is being excavated concurrently. Since the basement is constructed and lowered into the ground part by part, this method has the difficulties of accurately matching or joining the individual parts. Defective joints between the individual parts affects adversely the quality of the basement.

SUMMARY OF THE INVENTION

An object of the invention is to provide an improved process for constructing a basement which overcomes the disadvantages of the prior methods described hereinbefore.

Another object of the invention is to provide an improved process of basement construction which is easier than the prior methods described above.

According to the present invention, a process for constructing a basement comprises the steps of: (a) excavating spaced vertical holes along the border of a construction site to the depth of bearing strata for the basement; (b) forming piles at the bottoms of the vertical holes; (c) erecting steel posts in said vertical holes on said piles to serve as main posts of the basement; (d) excavating soil from all area of the construction site to form an upper part of a cavity to receive the basement, the depth of said upper part of said cavity being far above the bearing strata; (e) forming upper portions of concrete walls of the basement in said cavity along the border of the construction site; (f) forming the remaining portions of said concrete walls extending downward from the bottoms of said upper portions of said concrete walls to the bearing strata by alternatively repeating the steps (d) and (e). Certainly, the process may further comprises the step (g) forming a concrete floor of the basement when performing the step (d) or (e).

The process of the present invention can alleviate the problem of endangering workmen because the formation of the concrete wall of the basement begins in a shallow excavation and is then continued in steps to the bearing strata so that soil collapse is prevented even when the hole is of the deepest. In addition, it is easier to begin the fabrication of the concrete walls near the surface higher level than at a deeper level.

The present exemplary preferred embodiment will be described in detail with reference to the accompanying drawings, in which:

DETAILED DESCRIPTION OF THE PREFERRED EMBODIMENTS

Figure 1:
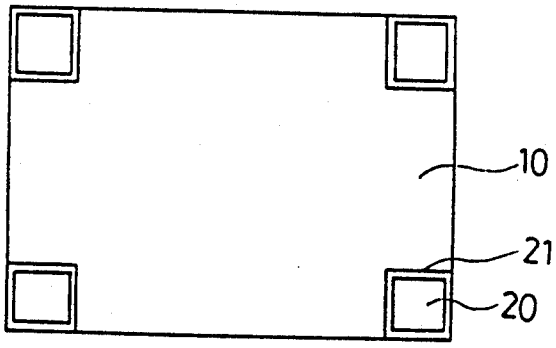
FIGS. 1, 2 and 3 show the excavation of vertical holes at the corners of a rectangular construction site.
Figure 2:
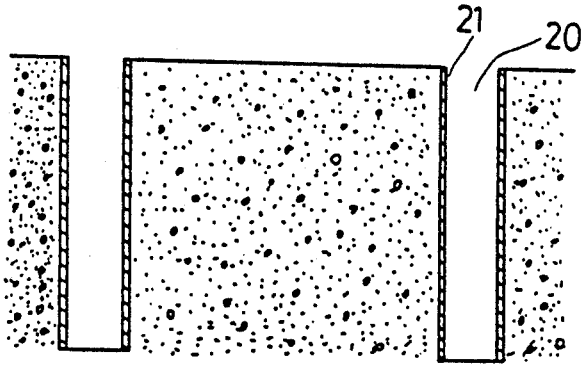
Figure 3:
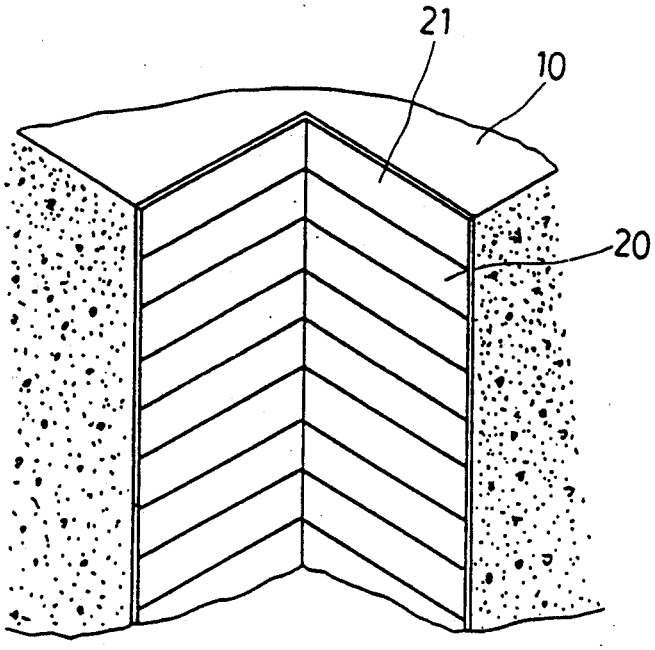
Figure 4:
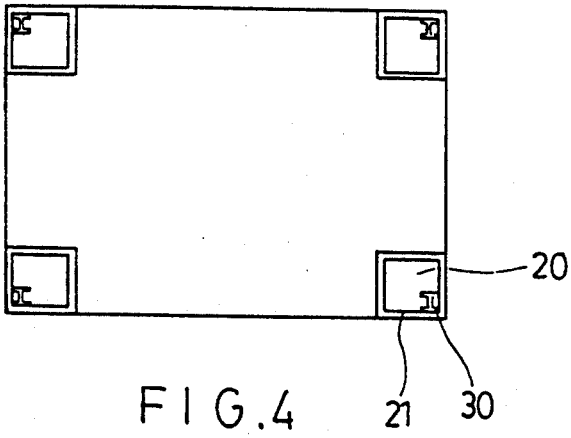
FIGS. 4 and 5 show that steel posts are lowered into the holes.
Figure 5:
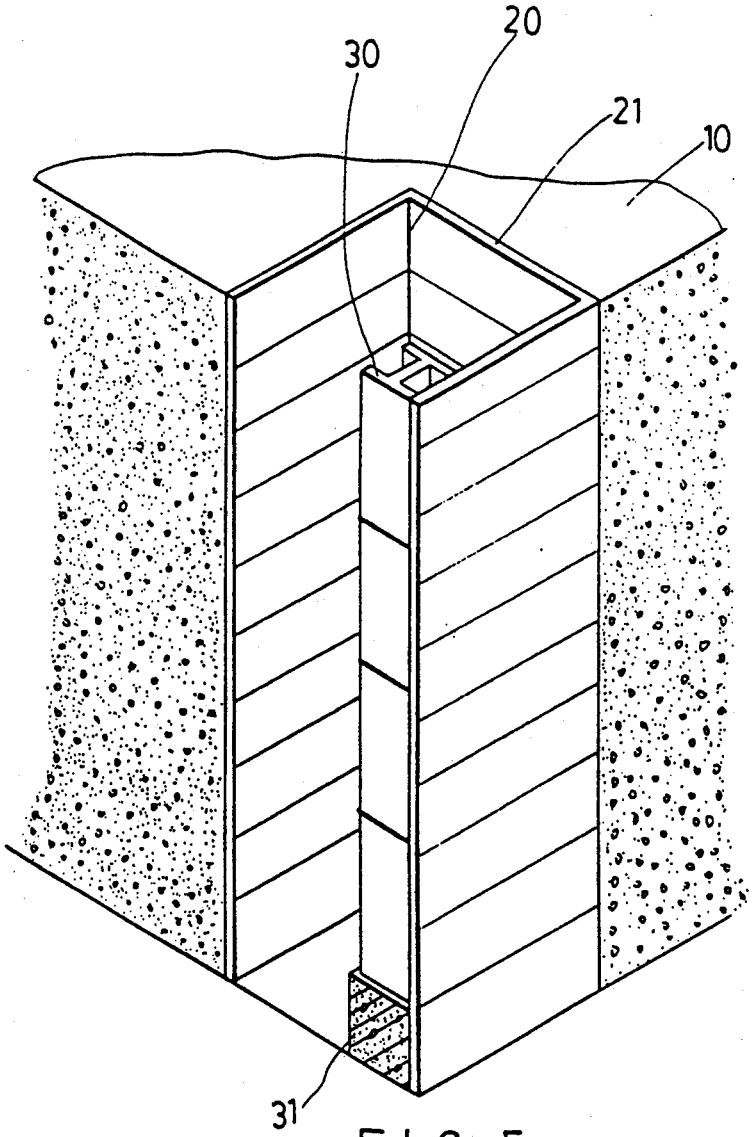
Figure 6:
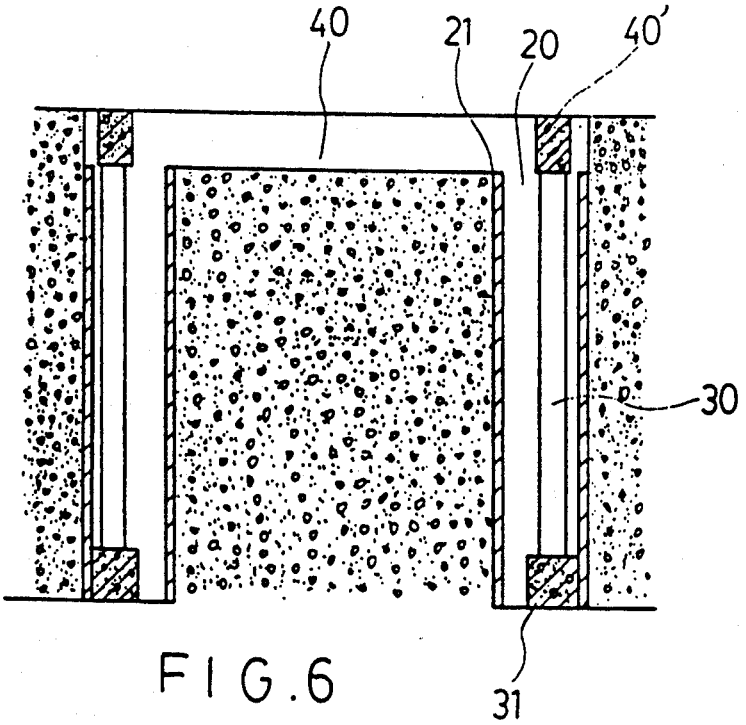
FIG. 6 shows that piles are formed at the bottoms of the holes.

Referring to FIGS. 1, 2 and 3, vertical holes 20 are dug to the depth of bearing strata at four corners of a rectangular construction site 10 for constructing a basement. Fence panels 21 are installed in the holes 20 so as to prevent the soil surrounding the holes from collapsing. Steel posts 30 which will serve as the vertical posts of the basement are lowered into each hole 20 as shown in FIGS. 4 and 5. Referring to FIG. 6, the bottom ends of the steel posts 30 are erected on piles 31 previously formed at the bottom of the holes 20 by pouring concrete through the holes 20.

Figure 7:
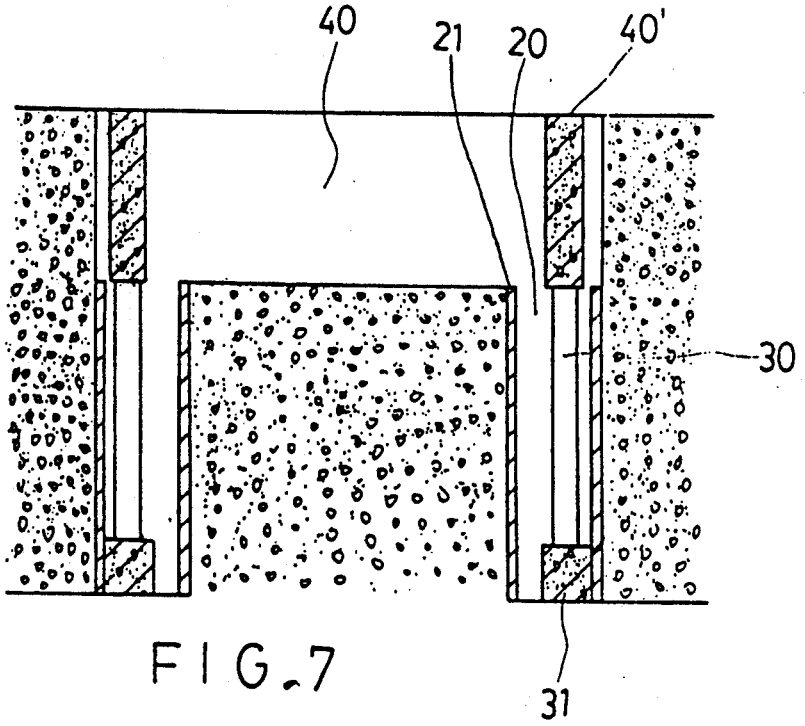
FIG. 7 shows that all area of the construction site is first excavated to a depth far above the bearig strata and the formation of concrete walls begins.
Figure 8:
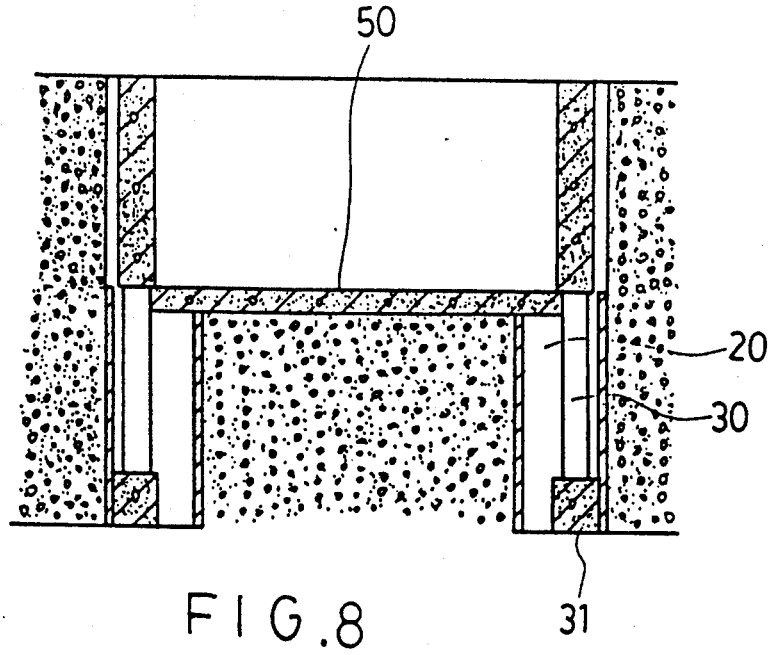
FIG. 8 shows that a first floor of the basement is formed.

After the steel posts 30 are installed, soil is exavated from the entire area of the construction site to initially form an upper portion of a cavity 40 to accommodate the basement, as shown in FIG. 7. The depth of the cavity 40 at this stage is far about the bearing strata. Upper portions of concrete walls 40' which will later constitute the basement are formed along the walls of the excavated cavity 40. Other component parts of the first floor of the basement such as horizontal beams, vertical support beams, floor reinforcement rods, etc., can be fastened to the vertical steel posts 30. FIG. 8 shows that the cavity 40 is subsequently excavated to a depth similar to the depth of the first floor of the basement. At that point, the concrete walls 40' are subsequently formed to reach the same depth, and the first floor 50 is formed at said depth. Then, the soil is excavated again from below the first floor 50 through the holes left in the floor for excavation. The process of excavation is known and will not be described herein.

Figure 9:
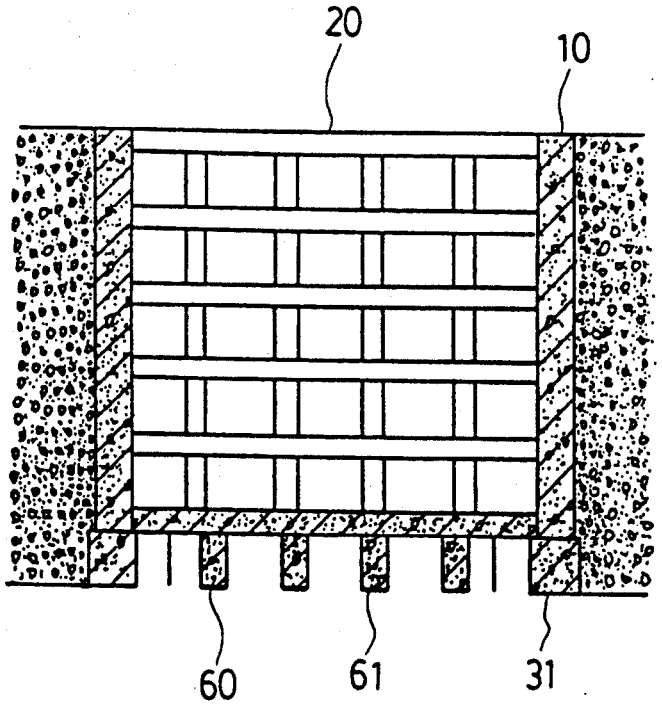
FIG. 9 shows the finished basement.

The excavation and the formation of the concrete are performed alternatively until reaching the depth of the bearing strata. When the depth of the cavity 40 reaches the bearing strata, additional piles 61 are formed as shown in FIG. 9.

With the invention thus explained, it is apparent that numerous variations and modifications can be made without departing from the scope of the invention. It is therefore intended that the invention be limited as only indicated in the appended claims.

I claim:

1. A process for constructing a basement comprising:

(a) excavating spaced vertical holes along the perimeter of a construction site to the depth of bearing strata for the basement;

(b) forming piles at the bottoms of the vertical holes;

(c) erecting steel posts in said vertical holes on said piles to serve as main posts of the basement;

(d) excavating soil from the entire area of the construction site to form an upper part of a cavity to receive the basement, the bottom of said upper part of said cavity being far above the bearing strata;

(e) forming upper portions of concrete walls of the basement along the wall of said cavity;

(f) forming the remaining portions of said concrete walls extending downward from the bottoms of said upper portions of said concrete walls to the bearing strata by alternatively repeating the steps (d) and (e).

2. A process as claimed in claim 1, further comprising step (g): forming concrete floors of the basement while performing the step (d) or (e).

3. A process as claimed in claim 1, further comprising step (h): forming piles in the bearing strata after step (f).

* * * * *